United States Patent [19]

Hage

[11] 4,167,323

[45] Sep. 11, 1979

[54] REPRODUCTION APPARATUS FOR PRODUCING SIMPLEX OR DUPLEX COPIES

[75] Inventor: Charles T. Hage, Rochester, N.Y.

[73] Assignee: Eastman Kodak Company, Rochester, N.Y.

[21] Appl. No.: 838,507

[22] Filed: Oct. 3, 1977

[51] Int. Cl.[2] ..... G03G 15/00

[52] U.S. Cl. ..... 355/3 R; 96/1.4; 355/23

[58] Field of Search ..... 355/3 R, 4, 16, 23, 355/25, 26, 77; 271/186; 96/1 R, 1.4

[56] References Cited

U.S. PATENT DOCUMENTS

| | | | |
|---|---|---|---|
| 3,583,807 | 6/1971 | Pollock | 355/4 |
| 3,694,069 | 9/1972 | Yamaji et al. | 355/4 |

FOREIGN PATENT DOCUMENTS

| | | | |
|---|---|---|---|
| 48-3570 | 1/1973 | Japan | 355/23 |

*Primary Examiner*—R. L. Moses
*Attorney, Agent, or Firm*—William F. Noval

[57] ABSTRACT

Reproduction apparatus for producing simplex or duplex copies. A plurality of individual reusable photoconductive members are provided in a supply and are sequentially transported around a path back to the supply. Positioned along the path are charge, expose, development, transfer and cleaning stations. In the simplex mode, first toner images are sequentially formed on photoconductive members transported around the path and sequentially transferred at the transfer station to first sides of copy sheets brought into transferable relationship with the photoconductive members. In the duplex mode, first and second toner images are formed on first and second photoconductive members respectively transported around the path and the toner images are transferred at the transfer station to opposite sides of a copy sheet brought into transferable relationship with the first and second photoconductive members.

In either mode, the copy sheets and photoconductive members are separated, the toner image(s) fixed to the copy sheet and the photoconductive members returned to the supply for reuse.

5 Claims, 2 Drawing Figures

REPRODUCTION APPARATUS FOR PRODUCING SIMPLEX OR DUPLEX COPIES

BACKGROUND OF THE INVENTION

1. Field of the Invention

The invention relates generally to reproduction apparatus and more particularly to the production of both simplex and duplex copies by means of a single reproduction process in a copier.

2. Description of the Prior Art

Several techniques are known for forming duplex images on a final support medium such as a web or copy sheet. One such technique involves the use of two electrophotographic processes each of which includes an endless photoconductive drum or belt, and charge, expose, develop, transfer and cleaning stations disposed about the photoconductive drum or belt. The support medium is generally passed between the photoconductors and the first and second images formed respectively on said photoconductors are transferred to opposite sides of the support medium. This technique is disadvantageous in the cost of providing two complete photoconductive processes, and in the complexity, machine size and decreased reliability necessitated by the use of two such complete processes.

Another technique for forming duplex images involving one photoconductive system utilizes an intermediate image transfer member to receive the first image formed on the photoconductor before the image is transferred to the final support medium. The intermediate transfer member may be either a drum, roller or belt. The latter technique also suffers the disadvantages of increased cost, complexity and machine size and decreased reliability necessitated by the use of the intermediate transfer member. Additionally, the first image must go through two transfers increasing the probability of degradation in image quality on the final support medium.

A further technique for producing simplex or duplex copies utilizing only one electrophotographic process involves the formation of first images on the first sides of a plurality of copy sheets, the collection of all the copy sheets in an intermediate tray and then the transportation of the copies back through the electrophotographic process to form second images on the second sides of the copy sheets. This latter technique has several disadvantages. For example, since the first sides of all the copy sheets are developed before development of the second sides of the copy sheets a duplex copy is not available for proofreading until all of the first sides and one set of the second sides have been produced. Additionally, the relatively long paper paths required in passing copy sheets through the electrophotographic process twice increases the possibility of paper jams, reduces copier efficiency and productivity, and changes in environmental conditions between formation of the first and second images on the copy sheet may result in images of varying quality on opposite sides of a single sheet.

Still another duplex copying technique which is suitable for simplex copying involves a single electrophotographic process including forming first and second images sequentially on a photoconductor transferring the first image from the photoconductor to the first side of a copy sheet, fixing the first image to the copy sheet, inverting the copy sheet and, transferring the second image to the second side of the copy sheet. Such technique is disclosed in U.S. Pat. No. 3,506,347. This process has certain disadvantages in that the first image is fixed to the copy sheet before transfer of the second image thereto thus necessitating either the use of two fixing stations with attendant increased heat and power or the use of a solvent vapor tackifying station with problems of flamability and replenishment of the solvent.

An electrophotographic process for forming simplex images on copy sheets utilizing a pair of photoconductive members supported by an endless flexible belt is also disclosed in the prior art in U.S. Pat. No. 4,003,651.

SUMMARY OF THE INVENTION

According to the present invention, reproduction method and apparatus are provided for producing simplex or duplex images on copy sheets. A plurality of individual reusable photoconductive members are provided in a supply and are sequentially transported around an image formation and transfer path back to the supply. Copy sheets are fed into transfer relationship with the photoconductive members at a transfer station to receive toner images from the photoconductive members. Preferably, the images are then fused to the copy sheets.

According to an aspect of the invention, in the simplex mode, first toner images are sequentially formed on photoconductive members transported around the path and sequentially transferred at the transfer station to first sides of copy sheets brought into transferable relationship with the photoconductive members. The copy sheets and photoconductive members are then separated, the simplex images are fixed to the copy sheets, and the photoconductive members are returned to the supply for reuse.

According to a further aspect of the invention, in the duplex mode, first and second toner images are formed on first and second photoconductive members transported around the path and the toner images are transferred to opposite sides of a copy sheet brought into transferable relationship with the first and second photoconductive members. After separation of the copy sheet from the photoconductive members, the duplex images are fixed to the copy sheet and the photoconductive members are returned to the supply for reuse.

The invention, and its features and advantages will be set forth and become more apparent in the detailed description of the preferred embodiment presented below.

BRIEF DESCRIPTION OF THE DRAWINGS

In the detailed description of the preferred embodiment of the invention presented below reference is made to accompanying drawings.

DESCRIPTION OF THE PREFERRED EMBODIMENT

To assist the understanding of the present invention, the operation of electrophotographic apparatus in which the invention may be used will be briefly described. It is to be understood, however, that the apparatus of the present invention could be used with equal facility and advantage in other copying machines and therefore that the following description of apparatus related to but not forming part of the invention is provided for illustrative purposes only.

Figure 1:
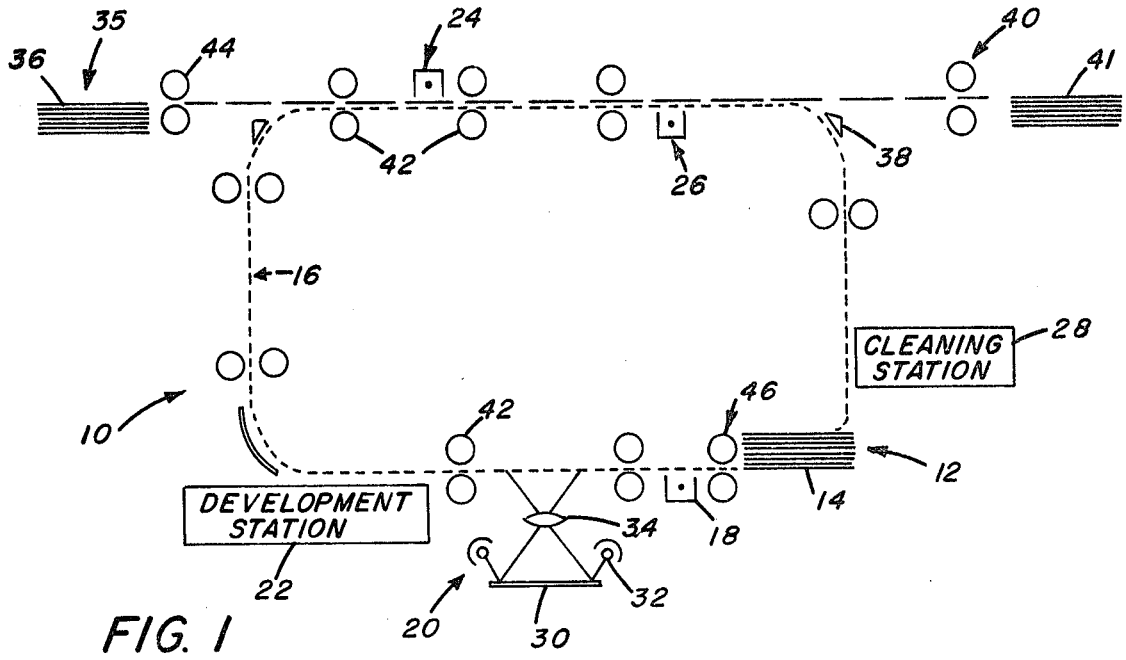
FIG. 1 is a schematic diagram of an electrophotographic copier according to the present invention for making simplex copies.

Reference is now made to FIG. 1 wherein a preferred embodiment of the present invention as used for making simplex copies on copy sheets is schematically illustrated. As shown, electrophotographic apparatus 10 includes a supply 12 of reusable photoconductive members 14, members 14 being adapted to be transported around path 16. Path 16 includes a charging station 18, an exposure station 20, an image development station 22, first transfer and detact station 24, second transfer and detack station 26, and cleaning station 28.

These stations will briefly described as follows:

Photoconductive member supply 12 supports a plurality of reusable photoconductive members 14 in a tray or the like whereby members 14 are sequentially fed out from the bottom of a stack of members 14 disposed in the tray along path 16 and returned to the top of the track of photoconductive members 14 after transport around path 16.

Photoconductive members 14 may be of any suitable structure but preferably include a photoconductive layer of suitable photoconductive material in contact with a conductive layer. A commonly used photoconductive member includes zinc oxide as the photoconductive layer in conductive contact with a conductive layer. It should be understood however that any other type of photoconductive layer may be used utilizing other photoconductive materials well known to those skilled in the art.

As photoconductive member 14 is transported along path 16 with the photoconductive layer facing outwardly, at charging station 18, which may, for example include a corona charging device, a uniform charge is produced on the photoconductive layer of member 14. The charge produced may, for example, be a negative DC charge.

At exposure station 20, an original such as a document 30 is illustrated by radiation from flash lamps 32. The reflected image produced thereby projected by lens 34 onto the photoconductive layer of member 14 to produce a latent electrostatic image on member 14. Any other exposure device well-known to those skilled in the art may also be used.

As member 14 is further transported along path 16, development station 22 contacts the photoconductive layer of member 14 with toner particles which adhere by electrostatic attraction to member 14 in the areas where a latent image which has been formed, thereby forming a transferable toner image corresponding to the image of original 30.

A supply 35 of plain paper copy sheets 36 is provided to supply copy sheets to which toned images formed on photoconductive members 14 may be transferred. In the simplex mode, toner images are transferred to first sides only of copy sheets 36; in the duplex mode consecutive images on first and second photoconductive members 14 are transferred to opposite sides of a copy sheet 36. In the embodiment of FIG. 1, successive images on photoconductive members 14 are consecutively transferred to the lower sides of consecutive copy sheets 36 to form simplex copies. Copy sheets are transported at the same rate as that of photoconductive members 14 along a portion of path 16 in transferable relationship with members 14.

In operation, a copy sheet 36 is transported into registration with a photoconductive member 14 upon which a toner image has been formed and transported together past transfer station 24 at which toner particles on member 14 are transferred in an imagewise configuration to the receiving face of copy sheet 36. Station 24 includes a negatively charged DC corona that applies a negative charge to the back of copy sheet 36 thereby drawing sheet 36 into transfer contact with member 14. Transfer station 24 may also include an AC corona detack device which removes the charge from copy sheet 36 in order to render it substantially neutral in electrical charge.

As member 14 in registration with a copy sheet 36 is further transported along path 16 a diverter 38 causes member 14 to continue along transport 16 past cleaning station 28 where any residual toner or electrical charges are removed from member 14 which is thereafter transported on to the top of the stack of members 14 at supply station 12. Copy sheet 36 passes between fusing rollers 40 which fix the toner image to copy sheet 36. The copy sheet is then delivered to output station 41.

Photoconductive members 14 are transported along path 16 by means of a plurality of transport rollers 42 disposed along path 16. Copy sheets 36 are fed from sheet supply 34 by means of feed rollers 44 which act to feed single sheets seriatim from supply 34. Feed rollers 44 may also include a registration device in order to register a copy sheet 36 with an image photoconductive member 14 transported around path 16.

Photoconductive members 14 may be fed out of supply 12 by any suitable feed device such as feed rollers 46.

Figure 2:
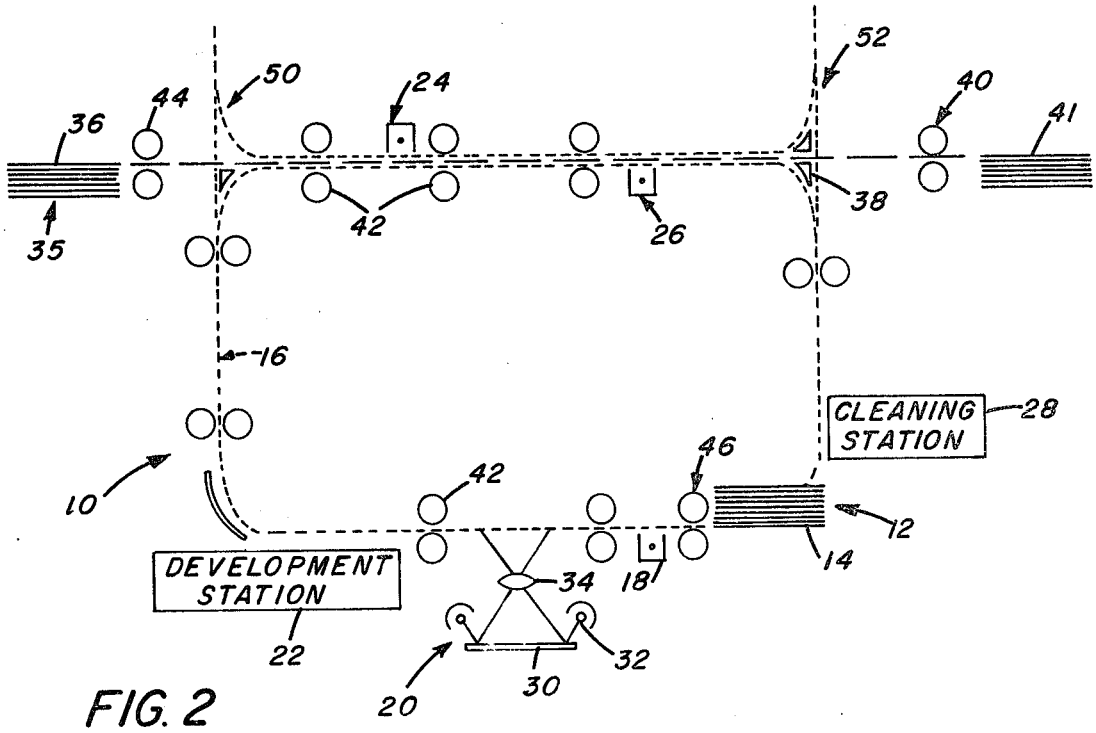
FIG. 2 is a schematic diagram of an electrophotographic copier according to the present invention in which duplex copies are made.

Referring now to FIG. 2 there is shown the electrographic copier shown in FIG. 1 but to be used for forming duplex images on opposite sides of copy sheet 36. In the duplex mode photoconductive members 14 are transported about path 16 at a rate which is twice the rate of transport of copy sheets 36. This permits successive photoconductive members to have first and second toner images formed thereon with the first member being inverted at turnaround area 50 and the toner image thereon being brought into facing engagement with the upper side of copy sheet 36 at the same time that the second photoconductive member having another toner image is brought into facing engagement with the lower side of same copy sheet. In such manner, first and second photoconductive members having first and second toner images are brought into image transferable relationship with a single copy sheet for subsequent transfer of both images to opposite sides of the copy sheet. As the sandwich of first and second photoconductive members 14 and copy sheet 36 are transported along together, at first transfer station 24 a toned image on the second photoconductive member 14 is transferred to the lower side of copy sheet 36. Thereafter at transfer station 26 the toner image on the first photoconductive member 14 is transferred to the upper side of copy sheet 36. In this manner, duplex toner images are formed on opposite sides of copy sheet 36.

As the photoconductive members 14 and copy sheet 36 are further transported to the right the photoconductive members are separated from contact with copy sheet 36 which continues in a straight path to fusing station 40 where the duplex images are fused to opposite faces of copy sheet 36 and the copy is delivered to output station 41. The lower member 14 is diverted downwardly past cleaning station 28 where any residual developer material is removed from the photoconductive surface of member 14 before it is stacked on the top of supply 12. Meanwhile, the upper photoconductive member 14 is deflected upwardly, reversed at turnaround area 52 and fed downwardly past cleaning station 28 in the space between successive copy sheets 36. The upper photoconductive member 16 is likewise cleaned at cleaning station 28 and fed onto the top of supply 12.

Devices for turning around sheets are well-known in the art. For example, commonly assigned U.S. Pat. No. 3,672,765 issued June 27, 1972 by C. Altmann entitled: "Apparatus for Making Two Sided Copies From Two Images On An Original" discloses a copy sheet reversing mechanism including a deflector, a pair of rollers, a compressed air nozzle and an endless belt which forms a nip with one of the rollers. Such a sheet turnaround device could be used to effect turnaround of photosensitive member 14 at turnaround areas 50 and 52.

In either the simplex mode illustrayted in FIG. 1 or the duplex mode illustrated in FIG. 2, where the exposures at exposure station 20 of original documents are in precollated exposure sequence then a collated sequence of copy sheets may be produced.

Thus it is seen that reproduction method and apparatus are provided wherein simplex or duplex copies may be produced by means of a single reproduction process. Complex copy sheet handling is avoided due to the simple substantially straight paper path between input and output. Increase of the life and rest time of the photoconductive members may be effected by increasing the supply thereof. In addition, worn out photoconductive members may be easily replaced in the supply.

The invention has been described in detail with particular reference to preferred embodiment(s) thereof, but it will be understood that variations and modifications can be effected with the first and scope of the invention.

What is claimed is:

1. A method for producing duplex copies comprising:

supplying a plurality of individual reusable photoconductive members at a supply location;

sequentially transporting at least first and second photoconductive members from said supply location along a path back to said supply location;

forming first and second transferable toner images on said first and second members respectively as they are transported along said path; and transferring said first and second toner images from said first and second photoconductive members to the opposite sides respectively of a copy sheet brought into image transferable relationship with said members along an image transfer portion

2. The method of claim 1 including fixing said first and second toner images to said copy sheet.

3. The method of claim 1 wherein forming of said toner images includes charging said photoconductive members with a uniform charge, exposing said uniformly charged photoconductive members radiation images to form electrostatic to be reproduced and developing the latent images with toner to form toner images on said photoconductive members.

4. Apparatus for producing duplex copies comprising:

supply means for supplying a plurality of reusable photoconductive members;

transport means for sequentially transporting at least first and second photoconductive members seriatim from said supply means along an image reproduction path back to said supply means;

imaging forming means for forming first and second toner images on said first and second respective photoconductive members as they are transported along said image reproduction path; and image transfer means for transferring said first and second toner images from said first and second photoconductive members to opposite sides of copy sheet brought into image transferable relationship with said photoconductive members along an image transfer portion of said path.

5. The apparatus of claim 4 wherein said image forming means includes charge means for charging said photoconductive members with a uniform charge, exposure means for exposing said uniformly charged photoconductive members to a radiation image to form first and second electrostatic latent images thereon representative of originals to be reproduced and development means for developing the latent images with toner particles to form first and second transferable toner images respectively on said first and second photoconductive members.

* * * * *

UNITED STATES PATENT AND TRADEMARK OFFICE

CERTIFICATE OF CORRECTION

PATENT NO. : 4,167,323

DATED : September 11, 1979

INVENTOR(S) : Charles T. Hage

It is certified that error appears in the above-identified patent and that said Letters Patent are hereby corrected as shown below:

Claim 1, line 8, after "portion" insert --of said path.--

Claim 3, line 14, after "members" insert --to--.

Claim 3, line 15, after "electrostatic" insert --latent images thereon representative of originals--.

Claim 4, line 32, after "of" insert --a--.

Signed and Sealed this

*Eighth* Day of *July 1980*

[SEAL]

*Attest:*

SIDNEY A. DIAMOND

*Attesting Officer*

*Commissioner of Patents and Trademarks*